US005141465A

United States Patent [19]

Stellman

[11] Patent Number: 5,141,465

[45] Date of Patent: Aug. 25, 1992

[54] STUFFED FISH TOY

[76] Inventor: James H. Stellman, Rte. 2 Box 253, Cokato, Minn. 55321-9430

[21] Appl. No.: 736,419

[22] Filed: Jul. 26, 1991

[51] Int. Cl.[5] ..... A63H 3/02; A63H 3/24; A63H 3/36; A63B 71/00

[52] U.S. Cl. ..... 446/372; 446/304; 446/395; 446/901; 273/140; 273/DIG. 30

[58] Field of Search ..... 273/140, DIG. 30; 446/268, 304, 305, 368, 369, 370, 371, 372, 395, 901, 138, 139, 226, 225; 434/272

[56] References Cited

U.S. PATENT DOCUMENTS

| | | | |
|---|---|---|---|
| 2,107,672 | 2/1938 | Lang | 446/139 |
| 2,557,789 | 6/1951 | Lamka | 446/139 |
| 3,214,863 | 11/1965 | Bernstein et al. | 446/139 |
| 3,748,779 | 7/1973 | Cherk et al. | 446/370 |
| 3,788,641 | 1/1974 | Lemelson | 273/DIG. 30 X |
| 4,170,086 | 10/1979 | Hills | 446/372 |
| 4,762,494 | 8/1988 | Woods | 446/372 X |
| 4,776,823 | 10/1988 | Hanlon | 446/372 X |
| 4,822,285 | 4/1989 | Summerville | 434/272 |
| 4,929,213 | 5/1990 | Morgan | 446/369 X |
| 4,964,832 | 10/1990 | Bickoff | 446/901 X |
| 5,031,908 | 7/1991 | Spector | 446/225 X |

FOREIGN PATENT DOCUMENTS

| | | | |
|---|---|---|---|
| 894516 | 10/1953 | Fed. Rep. of Germany | 446/139 |

*Primary Examiner*—David N. Muir

[57] ABSTRACT

A toy including a flexible cover having a fish-like shape, a filler material contained within the flexible cover, and an engagement material attached within an indented area within the flexible cover. The flexible cover has an area at one end defining a mouth for the fish-like shape. The filler material is generally pliable. The filler material at least partially fills the flexible cover. The engagement material is suitable for contact engagement with another material exterior of the cover. The engagement material is threadedly fastened to the mouth area of the flexible cover. The engagement material is a loop material. The loop material is suitable for contact engagement with a hook material. A fishing lure apparatus is provided. The fishing lure apparatus is covered with a hook material. This hook material can engage the loop material of the mouth of the flexible cover.

8 Claims, 2 Drawing Sheets

STUFFED FISH TOY

TECHNICAL FIELD

The present invention relates to stuffed animals. More particularly, the present invention relates to stuffed animals which can aid children in the development of fishing skills as well as eye to hand coordination.

BACKGROUND ART

Toys are play objects used primarily by children. Natural objects, such as sticks, fir cones, seed pods, bones, and smooth round stones, may well have been the first toys. Dolls, balls, spin-tops, and pull-toys made of a wide variety of materials are the fundamental toys of nearly every culture. The animal was an early and fundamental toy shape. Although some of the animal figures found at ancient sites may have been used as ornaments or as miniature representations of objects intended to accompany the dead into the afterlife, a few animal shapes have been found that seem to have been intended for use only in play. Wheeled pull- or push-toys carved in the shapes of animals in white limestone came from Persia of the 12th century B.C., for example. Clues to the nature of many old toys have been found on ancient paintings, which often depict hobbyhorses, carts, tops, balls, and musical instruments.

Various U.S. patents have been directed toward stuffed animal toys. U.S. Pat. No. 3,748,779, issued on Jul. 31, 1973, to Cherk et al. describes a soft manipulatable figure toy in the form of a fish. This toy comprises a flexible cover, or body material, defining an animal form and including a fluent particulate partial filler of a non-toxic edible cereal grain. In particular, this stuffed animal, in the form of a fanciful whale, has a cover made of a soft flexible cover, such as a textile web. In particular, the inventors found that a corduroy type fabric was found to be particularly suitable in providing the proper tactile properties. The mouth of the whale described in U.S. Pat. No. 3,748,779 does not open, or cooperate, in any way, with any other apparatus.

U.S. Pat. No. 4,822,285, issued on Apr. 18, 1989, describes an anatomically stuffed toy animal. This toy animal has an abdominal cavity which is covered by a flap. The flap is normally secured in a closed position through the use of a zipper or by VELCRO (TM) fasteners. Stuffed fabric internal organs are removably received in the abdominal cavity. The stuffed organs are retained in anatomically correct positions through the use of cooperating VELCRO (TM) fasteners. The VELCRO (TM) fasteners are also provided on the exterior surface of the abdominal flap for displaying the various stuffed organs in anatomically correct relative positions for educational purposes. An additional hollow cavity is provided in the head of the stuffed toy animal and provided with an audio educational tape playing device.

It is an object of the present invention to provide a toy stuffed fish with a functional mouth area.

It is another object of the present invention to provide a home game in which a fish may be captured by tossing a lure.

It is another object of the present invention to provide a toy stuffed fish which is easy to manufacture, safe to use, and relatively inexpensive.

These and other objects and advantages of the present invention will become apparent from a reading of the attached specification and appended claims.

SUMMARY OF THE INVENTION

The present invention is a toy fish that comprises a flexible cover having a fish-like shape, a filler material contained within the flexible cover, and an engagement material attached within an indentation in the flexible cover. Specifically, the flexible cover has an area at one end that defines a mouth for the fish-like shape. The filler material is generally pliable. The filler material at least partially fills the flexible cover. The engagement material is suitable for contact engagement with another material exterior of the cover.

The flexible cover further includes a tail section at an end opposite to the mouth of the flexible cover. The flexible cover also has a fin section that is disposed between the tail section and the mouth. The fin section extends outwardly along an upper edge of the flexible cover. The tail section and the fin section are formed from a felt material. The tail section and the fin section are threadedly connected to the flexible cover.

The engagement material is also threadedly fastened to the mouth area of the flexible cover. The engagement material has a first surface formed along a first section of this mouth area. The engagement material also has a second surface formed along a second section of this mouth area. The first and second sections are connected together along a common edge. In one embodiment, the engagement material is a loop material. This loop material is suitable for contact engagement with a hook material exterior of the flexible cover. In another embodiment, the engagement material is a hook material. This hook material is suitable for contact engagement with a loop material exterior of the flexible cover.

The present invention is also a game which employs the stuffed toy fish as described herein previously. The toy includes a rod, a line connected to the rod, and a lure attached to the end of the line opposite the rod. This lure is a hook-like or lure member that has sufficient weight to allow it to be tossed in a manner similar to casting. The hook member may be covered with either a hook material or a loop material. The type material which covers the hook member should be different than the material which is used as the engagement material in the mouth of the fish. When the lure is tossed by using the rod, the object of the game is to place the hook member in close proximity to the mouth of the fish. When the material on the hook member contacts the mouth of the fish, a "strike" is made. This allows the user of the rod to "reel in" the stuffed toy fish. When the user of the rod gets the stuffed toy fish completely off the ground and into his or her possession, a "catch" is made.

DETAILED DESCRIPTION OF THE INVENTION

Figure 1:
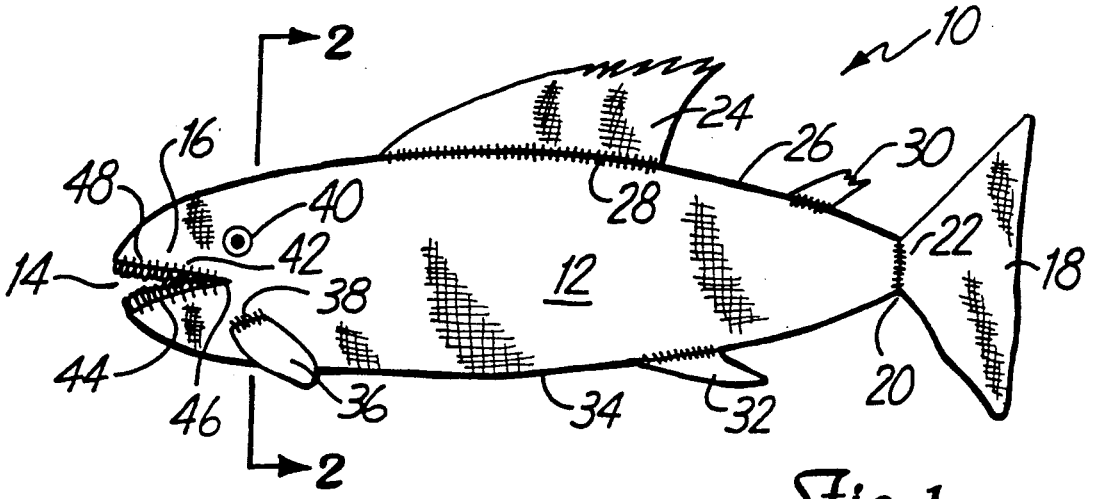
FIG. 1 is a view, in side elevation, of the toy stuffed fish in accordance with the preferred embodiment of the present invention.

Referring to FIG. 1, there is shown at 10 the toy stuffed fish in accordance with the preferred embodiment of the present invention. Toy stuffed fish 10 comprises a flexible cover 12, a filler material (shown in FIG. 2) and an engagement material 14. The flexible cover 12 has a fish-like shape. As can be seen in FIG. 1, flexible cover 12 has a functional mouth area 16 at one end. The engagement material 14 is attached within the mouth 16 of the flexible cover 12. The engagement material 14 is suitable for contact engagement with another material which is exterior of the cover.

The flexible cover 12 has a tail section 18 at the end 20 opposite the mouth 16. The tail section 18 has a generally triangular configuration and is threadedly connected to the end 20 of flexible cover 12. Threads 22 establish this threaded connection between the cover 12 and the tail section 18. A fin section 24 is disposed between the tail section 18 and the mouth 16 of the toy stuffed fish 10. The fin section 24 resembles the fin of a fish and extends outwardly along the top edge 26 of flexible cover 12. The fin section 24 is connected to this top edge 26 by threads 28. An additional fin section 30 is also threadedly fastened to the top surface 26 of flexible cover 12. A bottom fin section 32 is threadedly fastened to the bottom edge 34 of flexible cover 12. Another fin section 36 is fastened so as to extend outwardly from the flexible cover 12. Fin section 36 is also connected to the flexible cover 12 by threads 38. It should be noted that when the toy 10 is modeled after a specific fish species, then the tail section 18 (and fins 24, 30, 32 and 36) will have the size, shape and placement as the real fish. A pair of eyes 40 are fastened to the exterior of the flexible cover 12 on opposite sides of the flexible cover. Where the toy 10 is modeled after fish species such as halibut, sole, flounder, etc., then the eyes 40 could be fastened to the same side of the head.

In the preferred embodiment of the present invention, the tail section 18 can be made of a felt material. In addition, the fin sections 24, 30, 32 and 36 may also be made of a felt material. The fins can easily be manufactured by simply cutting the fins from a sheet of felt. Importantly, however, this should not be construed as a limitation. The fins could also be made of leather or other material. Different types of fin material can be used for different types of fish. The flexible cover 12 may be made of any soft flexible cover such as a textile web, Deep Pile fabric (fake fur), corduroy, suede, silk, wool, or even a non-woven expanded vinyl. Additionally and furthermore, the flexible cover 12 and the filler material may be the same material in the form of a formed foam material, commonly known as "NERF (TM)" material.

It is important to the concept of the present invention that the area 16 at the end of the flexible cover 12, opposite the fin 18, is formed so as to resemble the mouth of a fish. An engagement material 14 is attached within this mouth 16. As can be seen in FIG. 1, the engagement material is a loop material, commonly known as VELCRO (TM). It can be seen that the engagement material 14 has a first surface which extends along a first section 42 of mouth 16. In essence, this loop material will act as the roof of the mouth of the fish. The engagement material 14 also has a second surface that extends along a second section 44 of the mouth 16. The first section 42 and the second section 44 of mouth 16 are joined along a common edge 46. It can be further seen in FIG. 1 that the engagement material 14 is connected to the first section 42 and to the second section 44 by a plurality of threads 48. Alternatively, the loop material can be adhesively fastened within the mouth 16 of cover 12. In the preferred embodiment of the present invention, the engagement material 14 within mouth 16 of fish-like cover 12 will closely resemble the action of the mouth of an actual fish.

Figure 2:
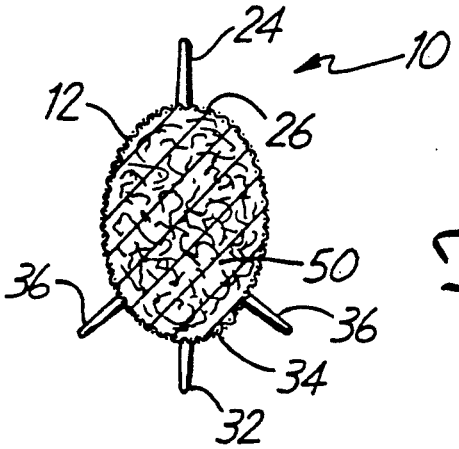
FIG. 2 is a cross-sectional view taken across lines 2—2 of FIG. 1.

FIG. 2 is a cross-sectional view of the toy stuffed fish 10. As can be seen, the cover 12 of fish 10 has a generally oval configuration. Within the interior of cover 12 is a filler material 50 The filler material 50 is contained within this flexible cover 12. The filler material 50 is generally pliable and at least partially fills the interior of the flexible cover 12. In FIG. 2, the filler material 50 comprises a plurality of foam balls. However, this should not be interpreted as a limitation on the scope of the present invention. A wide variety of other soft, pliable filler materials such as synthetic cotton or fiberfill can also be used for the purpose of filling the interior of the cover 12. The filler material can also be a recycled, or recyclable material, so as to add environmental appeal to the present invention. A weight may be added to the inside of toy 10 so that the fish will stand upright when it is tossed.

In FIG. 2, it can be seen that the fin section 24 is threadedly fastened to the exterior surface 26 of the flexible cover 12. The fin section 24 is generally thin and extends directly upwardly from the flexible cover 12. Bottom fin 32 is also threadedly fastened along the bottom surface 34 of flexible cover 12. The side fins 36 extend outwardly from the flexible cover 12 along the side of the fish. In the manner illustrated in FIG. 2, the flexible cover 12, and the associated fin sections, take on the appearance of a fish. The position, size, and shape of the fins (along with the material used) can be varied in accordance with the type of fish being modeled.

The toy stuffed fish makes an excellent toy for youngsters. It can also be an executive toy with a silk covering and leather fins. It closely resembles an actual fish and has a pleasant appearance and texture. The loop material used in the mouth 14 takes on the appearance of the teeth of many game fish. The toy stuffed fish 10 can be configured to resemble the different game fish found in different parts of the country. The toy stuffed fish 10 can be marked with cute names which identify the fish. Such names may include "Wally Walleye", "Norton Northern", "Bobby Bass", "Carl Catfish", "Suzy Sunfish", "Sammy Salmon", "Hillary Hallibut", and "Stewart Striper". A number of other names can be appropriate to the various types of fish that can be configured in the manner described herein previously.

Figure 3:
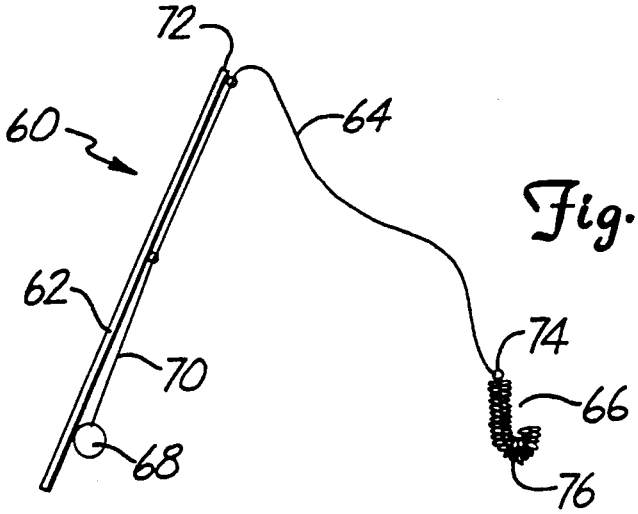
FIG. 3 is an illustration of the toy fishing rod for use in conjunction with the toy stuffed fish of the present invention.

To further accentuate the value of the toy stuffed fish 10 of the present invention, the fish can be used in conjunction with a skills game. Often, small children require practice in order to emulate the skills of their parents. If the children see the parents fishing, then the children will desire to have a toy which resembles the act of fishing. FIG. 3 illustrates the toy stuffed fish 10 can become part of a skills game for children.

FIG. 3 illustrates a toy fishing rod 60. Toy fishing rod 60 includes rod 62, line 64, and hook member 66. The hook member 66 can also take on the appearance of several different real fishing lures. Essentially, the rod 62 may have a reel 68 and an extendible, or retractable, line 70 running along the rod 62. Alternatively, the line 64 can simply be connected to the end 72 of rod 62. Line 64 extends outwardly for a distance and is joined at 74 to hook member 66. The hook member 66 generally takes on the appearance of a conventional hook. However, since the safety of the children using the toy of the present invention is important, the hook member 66 should not be pointed, or otherwise hazardous to safety. Importantly, hook member 66 includes a VELCRO (TM) material 76 around the exterior surface of the hook member 66. In particular, the VELCRO (TM) material should be a hook-type material.

In normal practice, the toy stuffed fish 10 may be laying on a surface adjacent to the child. When the child has the fishing rod 16 in his or her hands, the child may "cast", or otherwise deliver or move, the hook 66 outwardly in the vicinity of the toy stuffed fish 10. The line 64 may be reeled, or pulled in, so as to bring the hook material 76 on hook 66 in close proximity to the loop-type engagement material 14 of the mouth 16 of toy stuffed fish 10. When contact is established between the hook material 76 and the loop material 14, then the toy stuffed fish 10 is captured. The contact between the engagement materials will allow the fish to be "reeled in".

Figure 4:
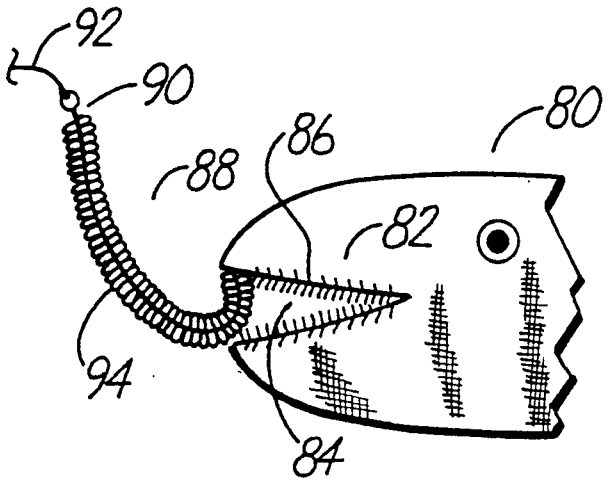
FIG. 4 is an illustration of an alternative embodiment of the toy stuffed fish of the present invention and shows, in particular, the manner in which the fishing rod is used to "capture" the fish.

FIG. 4 shows, in closer detail, the manner of capturing fish 80. Fish 80 also shows an alternative embodiment of the present invention. In particular, fish 80 has a mouth 82. Within mouth 82 are sections of engagement material 84. However, in FIG. 2, the engagement material 84 is the "hook-type" VELCRO (TM) material. This hook-type VELCRO (TM) material 84 is fastened to mouth 82 by threads 86. The mouth 82 of fish 80 is open so as to act as a target for the lure member 88. The lure member 88 is a hook material 90 which is fastened to the line 92. The exterior of the lure member 88 is covered with loop-type VELCRO (TM) material 94.

As can be seen in FIG. 4, when the loop-type engagement material 94 encounters the hook-type material 84 within mouth 82 of fish 80, a contact engagement will occur. This allows the user of the fishing rod to pull the fish 80 in.

The present invention enhances the enjoyment of the children by allowing children to emulate the actions of their parents. It also provides a skills game in which eye-hand coordination is important so as to be able to capture the toy fish. The shape and appearance of the fish allows the children to identify fish which are quite common in their particular area of the country. As such, the present invention offers a desirable and important toy for children. Adults may also enjoy the toy stuffed fish in the game of the present invention.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A game comprising:

a body having a fish-like shape, said body having an area at one end defining a mouth area for said fish-like shape, said body comprising a flexible cover and a filling material so that said cover is at least partially expanded;

an engagement material contained within said mouth of said body, said engagement material being one texture of a hook-and-loop material, said engagement material having a first surface formed along a first section of said area, said engagement material having a second surface formed along a second section of said area; and a lure means exterior of said body, said lure means having a material attached thereto suitable for contact engagement with said engagement material said lure means comprising:

a rod;

a line connected to said rod; and a hook member fastened to an end of said line opposite said rod, said hook member having a material fastened thereto suitable for contact engagement with said engagement material, said material of said hook member being of a different texture of said hook-and-loop material than said engagement material.

2. The game of claim 1, said body comprising:

a flexible cover having a fish-like shape, said flexible cover having an area at one end defining a mouth for said fish-like shape; and a filler material contained within said flexible cover, said filler material being generally pliable, said filler material at least partially filling said flexible cover.

3. The game of claim 2, said flexible cover having a tail section at an end opposite said mouth, said flexible cover having a fin section disposed between said tail section and said mouth, said fin section extending outwardly along an edge of said flexible cover, said tail section and said fin section being threadedly connected to said flexible cover.

4. The game of claim 1, said body being mold formed from a foamed plastic material.

5. The game of claim 1, said engagement material being a loop material, said material for said hook material being a hook material, said loop material suitable for contact engagement with said hook material.

6. The game of claim 1, said engagement material being a hook material, said material for said hook material being a loop material, said hook material suitable for contact engagement with said loop material.

7. A toy fishing set comprising:

a flexible cover having a fish-like shape, said flexible cover having an area at one end defining a mouth for said fish-like shape;

a filler material contained within said flexible cove, said filler material being generally pliable, said filler material at least partially filling said flexible cover; and an engagement material attached within said mouth of said flexible cover, said engagement material suitable for contact engagement with another material exterior of said cover, said another material being wrapped around and adhered to a line dependent dangling hook member which is brought into engagement at some distance from said flexible cover, said engagement material having a first surface formed along a first section of said area, said engagement material having a second surface formed along a second section of said area, said first and second sections being connected along a common edge in said mouth of said flexible cover, said engagement material being one texture of a hook-and-loop material, said another material being of a different texture of said hook-and-loop material.

8. The toy of claim 7, said engagement material being threadedly fastened to said area defining a mouth.

* * * * *